US005084734A

United States Patent [19]

Yoshino et al.

[11] Patent Number: 5,084,734

[45] Date of Patent: Jan. 28, 1992

[54] DEVELOPER CONTAINER FOR AN IMAGE RECORDING APPARATUS

[75] Inventors: Masahiro Yoshino; Keisuke Yamaguchi, both of Hachioji, Japan

[73] Assignee: Konica Corporation, Tokyo, Japan

[21] Appl. No.: 672,077

[22] Filed: Mar. 19, 1991

[30] Foreign Application Priority Data

Mar. 22, 1990 [JP] Japan ..... 2-72711

[51] Int. Cl.[5] ..... G03G 15/06

[52] U.S. Cl. ..... 355/260; 222/DIG. 1; 355/298

[58] Field of Search ..... 355/260, 298, 245; 222/DIG. 1

[56] References Cited

U.S. PATENT DOCUMENTS

| | | | |
|---|---|---|---|
| 4,850,303 | 7/1989 | Cipolla et al. | 355/260 X |
| 4,868,599 | 9/1989 | Niki | 355/260 |
| 4,894,688 | 1/1990 | Taniguchi et al. | 355/298 |
| 4,899,690 | 2/1990 | Hacknauer et al. | 355/260 X |
| 4,963,940 | 10/1990 | Nemoto et al. | 355/260 |

FOREIGN PATENT DOCUMENTS

| | | | |
|---|---|---|---|
| 0184373 | 10/1984 | Japan | 355/298 |

*Primary Examiner*—A. T. Grimley
*Assistant Examiner*—Sandra L. Brase
*Attorney, Agent, or Firm*—Finnegan, Henderson, Farabow, Garrett, and Dunner

[57] ABSTRACT

A toner container detachably mounted to a developing unit of a copying apparatus which contains fresh toner to be supplied to the developing unit and also stores used toner thereinto. A partition plate, slidably provided inside the toner container, partitions the container into a first section for containing the fresh toner and a second section for containing the used toner. The toner container is also provided with an outlet for the fresh toner to exit from the first section and an inlet for the used toner to enter into the second section. A transmission mechanism converts the rotation of a developer roller of the developing device into a slide motion of the partition plate, thereby the volume of the first section decreases and the volume of the second section increases in accordance with the operation of the developing roller.

6 Claims, 6 Drawing Sheets

DEVELOPER CONTAINER FOR AN IMAGE RECORDING APPARATUS

BACKGROUND OF THE INVENTION

In conventional image recording apparatuses such as an electrophotocopying machine and an electrostatic image recording apparatus in which an electrostatic image is used, the electrostatic image is formed on an electrostatic image carrier, toner is stuck to the electrostatic image by an image developing unit to develop it, and the toner image obtained is transferred to and fixed on recording paper for the desired record. The electrostatic image carrier which finished the image transference has the remaining charge erased by a discharge electrode and has the remaining toner removed by a cleaning arrangement.

In the image developing unit mentioned above, a toner supply container can supply necessary amount of the toner from a toner supply section to a developer stirring section. If the toner in the toner supply section is decreased with the toner supply from the toner supply section repeated, a toner supply alarm lamp, for example, is lit. The toner supply container then should be replaced to supply the toner.

On the other hand, the toner removed by the cleaning arrangement is collected into a toner collection container provided around the cleaning arrangement.

Most of the conventional toner supply containers are independent of the toner collection containers. Such a construction is involved in a problem of replacement time of the toner collection container in which the toner remained on and removed from the surface of the electrostatic image carrier is collected. The toner collection containers ordinarily have no means that can detect and indicate amount of the collected toner. It has to be removed out to check the toner collection state.

Around 70% of the supplied toner is consumed, and the remaining of around 30% is removed by the cleaning arrangement and is collected in the toner collection container. If the toner collection container is failed to be replaced, the collected toner flows over out of the toner collection container, contaminating the surroundings. In order to solve such a problems, the Japanese Patent Laid Open 58-173783 and the Japanese Utility Model Open 61-37008, for example, disclosed features that no special containers are provided for the toner, the toner supply container is attached to the cleaning arrangement after supply so as to serve both for supplying and collecting the toner.

A structure in which the toner supply container and the toner collection container are integrated together was disclosed in, for example, the Japanese Patent Laid Open 59-184373. In the structure, a single toner container has a partition member provided therein for new toner containing section and collected toner containing section.

However, the structure mentioned above is not practical. The reason is that it has a disadvantage of positions of a toner supply opening and a waste toner collection opening embodied in the disclosure as some means are needed to discharge the toner from the toner container and to carrying the toner out of and/or in the toner container. It also is involved in a sealing problem between the partition member and the container body. It further is disadvantageous that the integration of the toner supply container and the toner collection container makes the whole toner container, resulting in increase of a volume occupied by it in the image recording apparatus. Further more large size of the container and uneven toner distribution makes the replacement of the container more difficult.

In view of the foregoing, it is a general object of the present invention to provide a developer container of small size and simple structure by which a toner collection container can be replaced securely whenever the toner supply container is replaced.

SUMMARY OF THE INVENTION

Briefly, the foregoing object is accomplished in accordance with aspects of the present invention by a developer container for an image recording apparatus which is demountably provided in a image developing unit of the image recording apparatus and can supply new developer and collect waste developer. The developer container is characterized in that it comprises a movable partition member therein to divide it to a new developer containing section having a developer supply opening and a waste developer collecting section having a waste developer collection opening and that the movable partition member is connected with a drive source of the image recording apparatus to move.

Also, the developer container is characterized in that the movable partition member can be moved in response to consumption of the new developer therein to contract volume of the new developer containing section and at the same time to expand volume the waste developer collecting section.

Further, the developer container is characterized in that the movable partition member can be moved in response to revolution of a developer carrier of the image developing unit.

BRIEF DESCRIPTION OF THE DRAWINGS

FIG. 5-A is a cross sectional view for the developer container 30 taken across A—A.

FIGS. 5C and 5-D are a cross sectional view for a portion around its center.

DETAILED DESCRIPTION OF THE INVENTION

The invention will be better understood from the following description taken in connection with the accompanying drawings.

Figure 6:
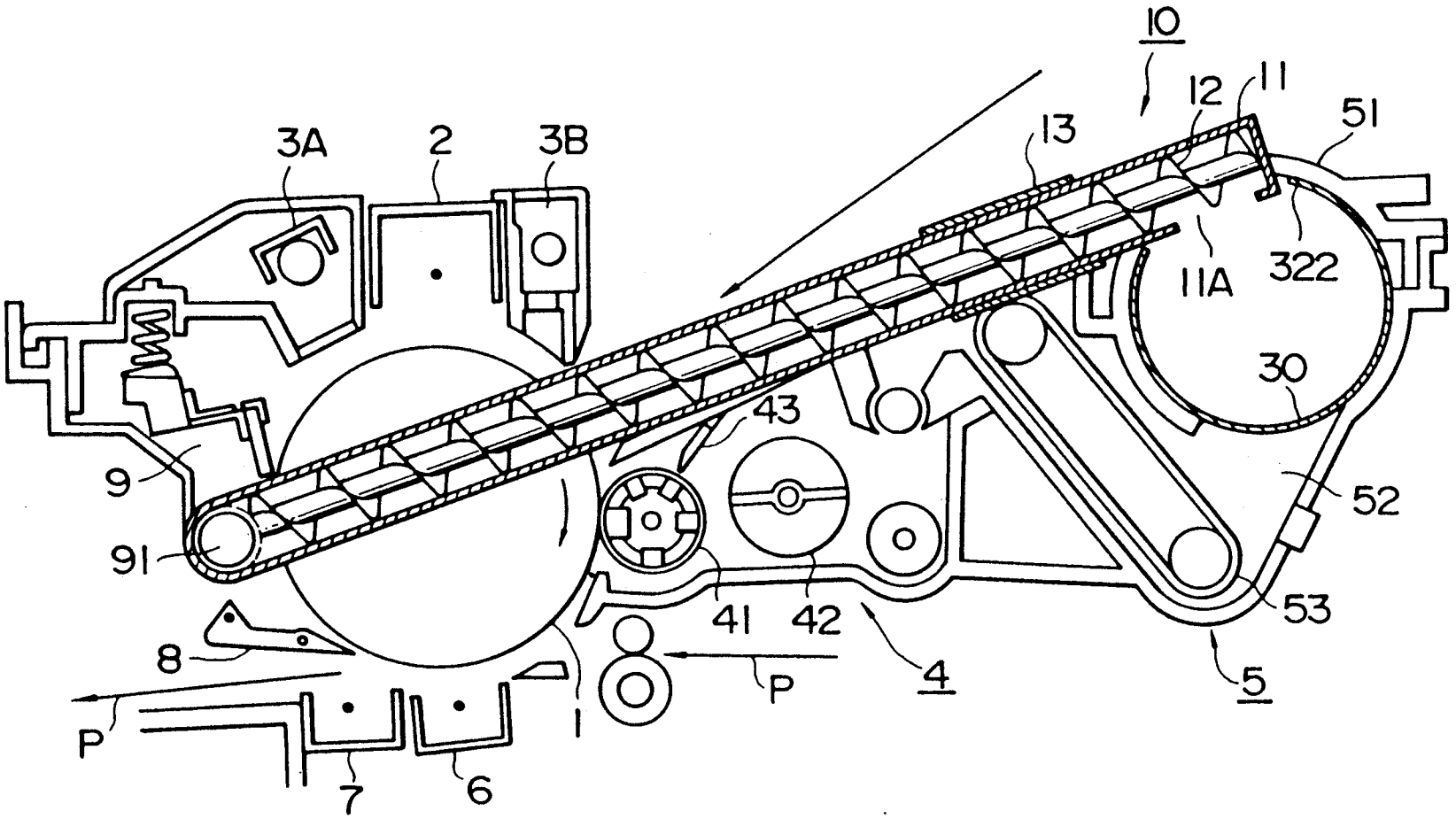
FIG. 6 is a cross sectional view for an image forming section of an image recording apparatus having a developer container according to the present invention.

FIG. 6 is a cross sectional view for an image forming section of an image recording apparatus having a developer container according to the present invention. In the figure, an image carrier 1 has image sensitizing layer evaporated or coated thereon on a conductive supporting cylinder. A charging electrode 2 is arranged right upward the image carrier 1. The charging electrode 2 can discharge corona to charge the image carrier 1 as the image carrier 1 is revolved. In front and in the rear of the charging electrode 2 are provided a front exposing lamp 3A and an erasing light emitting diode 3B, respectively, which can adjust a surface potential of the image carrier 1. A scanning optical not shown system irradiates a document image and focuses the document image on the image carrier 1.

An electrostatic latent image on the image carrier 1 corresponding to the document image can be developed by a image developing unit 4. The image developing unit 4 comprises a developer carrier 41 (developer roll) for carrying developer to a developing region for the image carrier 1, a developer stirring member 42, and a doctor blade 43.

A developer supply unit 5 connected with the image developing unit 4 comprises a container room 51 which can mount and demount a developer container 30 according to the present invention, a hopper room 52 which collects and stores toner supplied from the developer container 30, and a toner supply arrangement 53 which can properly supply the toner from the hopper room 52 to the image developing unit 4 to keep constant the toner concentration of the developer in the image developing unit 4.

When a toner image on the image carrier 1 reaches the transfer section, the toner image is transferred to the transfer paper P. The transfer paper fed in the transfer section is made to closely contact with surface of the image carrier 1. It has corona discharge of reverse polarity to the toner received toward its rear side by a transfer electrode 6 to have the toner image transferred.

The transfer paper P having the toner image transferred thereon is separated from the image carrier 1 by a separation electrode 7 and a separation pawl 8. It reaches a fixing section (not shown), is heated and fixed by a heating roller, and is discharged by a discharge roller.

On the other hand, the image carrier 1 having the transfer paper P separated is cleaned off the toner remained on its surface by a cleaning arrangement 9 to be recovered to its original state. After this, the above described image forming operation is repeated.

In FIG. 6 is shown a collected waste toner carrying arrangement 10 which can carry the collected waste toner to the developer container 30 from an inlet of a carrying screw 12 below the cleaning arrangement 9. The collected waste toner carrying arrangement 10 has a carrying screw 12 provided in a hollow cylinder 11. The carrying screw 12 is revolved by a drive arrangement (not shown) to push obliquely upward the collected waste toner exhausted from the opening of the lower outlet of the cleaning arrangement 9. The hollow cylinder 11 is pivotally supported at its lower end. It can be inserted downward and removed from a waste toner collection opening 322 of a developer container 30. The hollow cylinder 11 has a discharge opening 11A which is opened downward. The collected waste toner is discharged from the discharge opening 11A into a waste toner containing section 32 of the developer container 30. The hollow cylinder 11 can be opened or closed by a shutter 13. The shutter 13 is interlocked with a pivotal movement of the hollow cylinder 11 so as to slide along an outer surface of the hollow cylinder 11 to open or close the discharge opening 11A.

Figure 1:
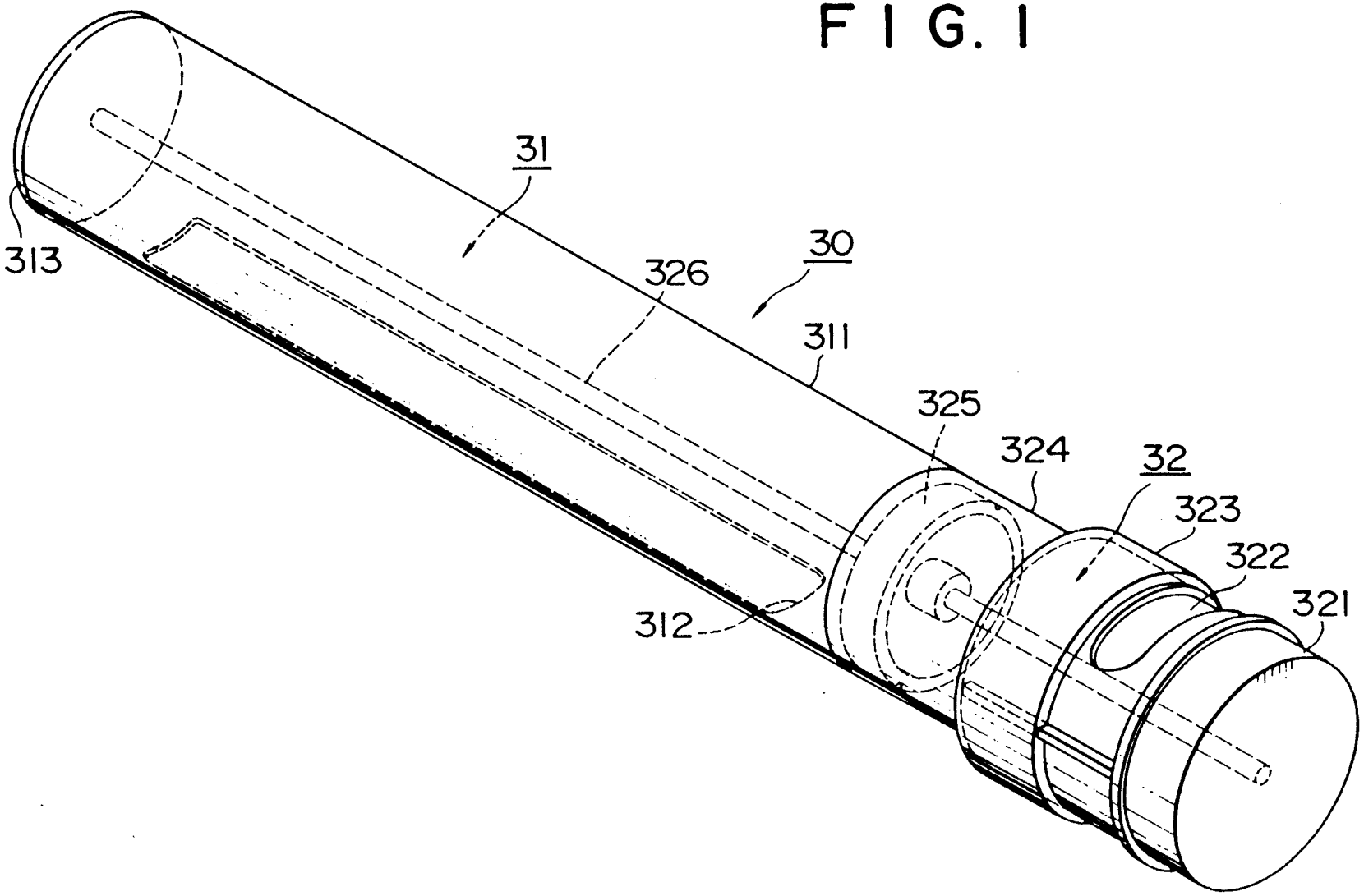
FIG. 1 is a perspective view for the developer container 30 according to the present invention.
Figure 2:
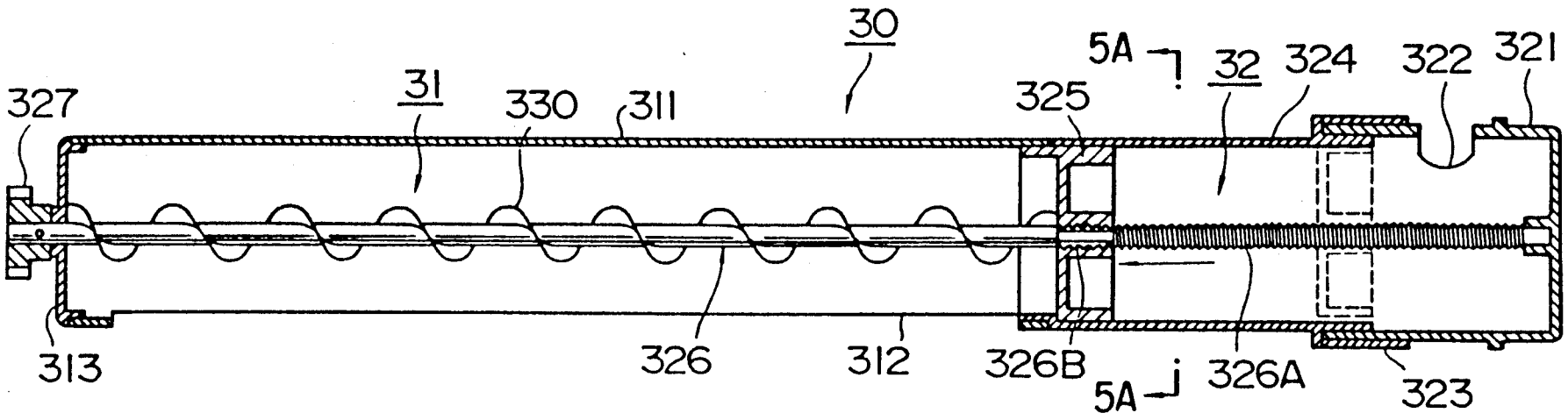
FIG. 2 is a cross sectional view for the developer container 30.
Figure 3:
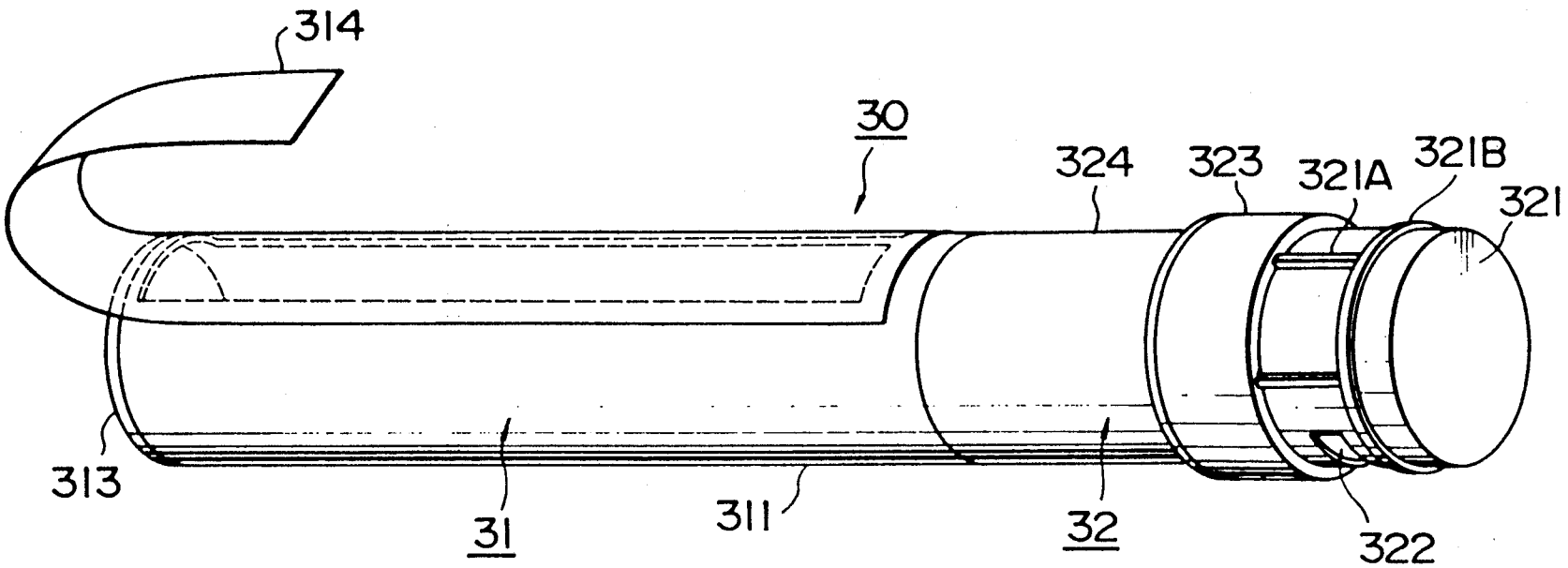
FIG. 3 is a perspective view for the developer container 30 with its toner supply opening directed upward.

FIG. 1 is a perspective view for the developer container 30 according to the present invention. FIG. 2 is a cross sectional view for the developer container 30. FIG. 3 is a perspective view for the developer container 30 with its toner supply opening directed upward. FIG. 5-A is across sectional view for the developer container 30 taken across A—A. In the figures is shown a supply toner containing section 31 for containing the toner before use and a waste toner containing section 32 for storing the waste toner collected from the cleaning arrangement 9. The developer container 30 comprises the supply toner containing section 31 and the waste toner containing section 32 as shown.

The supply toner containing section 31 comprises a hollow cylindrical body member 311 having a supply opening 312 which is longitudinally cut out on its cylindrical wall. A cap member 313 seals an opening at a rear (left) end of the body member 311, and a flexible sealing member 314, being adapted to be peeled off by hand seals the supply opening 312.

The waste toner containing section 32 comprises a hollow cylindrical container member 321 with its end closed having the waste toner collection opening 322 cut out circularly on its cylindrical wall, a shutter member 323 which can be slided lengthwise on the container member 321 to open or close the waste toner collection opening 322, and an intermediate body member 324. In the figures are shown a plurality of projections 321A which guides opening or closing motion of the shutter member 323 and a stopper 321B when the shutter member 323 closes.

The intermediate body member 324 has a movable partition wall 325 fitted on its inside wall which can be slided. The movable partition wall 325 has a female thread formed at its center portion. It also has long grooves 325A provided on parts of its outside circular wall in parallel with a revolving shaft 326 (see FIG. 5-A). The intermediate body member 324 has projections 324A provided on parts of its inside circular wall which can fit with the long grooves 325A. It allows the movable partition wall 325 to move in an axial direction of the revolving shaft 326.

The revolving shaft 326 is supported between the cap member 313 and container member 321 so as to revolve. The revolving shaft 326 has a male thread male thread 326A formed on a side of the waste toner containing section 32. The male thread 326A can be screwed into female thread of the movable partition wall 325. An left end (FIG. 2) of the male thread has a neck 326B having no thread. The revolving shaft 326 also has a gear 327 integrated at its leftmost end. The gear 327 can be revolved as interlocked with the developer carrier 41 of the image developing unit 4. The revolving shaft 326 has a spiral member 330 to stir the toner in the supply toner containing section 31. This prevents the toner in the supply toner containing section 31 from being solidified.

With the gear 327 driven to revolve, the revolving shaft 326 integrated with it is revolved, which can move straight ahead the movable partition wall 325 screwed with the male thread 326A of the revolving shaft 326 in an arrow direction from its home position indicated by broken lines as guided by the projections 324A. When the movable partition wall 325 is moved further so that its female thread is out of the male thread 326A of the revolving shaft 326 to the neck 326B, it is released from the screw. The movable partition wall 325 then is stopped even if the revolving shaft 326 continues to revolve.

In turn, the following describes manipulation and operation of the developer container 30 according to the present invention.

(1) The the developer container 30 should be held so that the waste toner containing section 32 of the developer container 30 directs toward the operator and the supply opening 312 directs upward. The cap member 313 should be directed forward and fitted with the container room 51 on top of the developer supply unit 5.

(2) In turn, the flexible sealing member 314 indicated in FIG. 3 should be peeled off with its end pulled. This make the supply opening 312 of the body member 311 open.

(3) The developer container 30 then should be pressed in so that the end gear 327 of the developer container 30 can be connected with a developer carrier 41 of the image developing unit 4.

(4) The front container member 321 for the waste toner containing section 32 should be turned 180 degrees by hand to turn the supply opening 312 downward. This allows the supply toner in the supply toner containing section 31 to drop down into the hopper room 52. At the same time, the waste toner collection opening 322 is directed upward to take in the waste toner.

(5) A lever (not shown) of the collected waste toner carrying arrangement 10 should be handled to move the shutter 13, which exposes the discharge opening 11A. This can be fitted with the waste toner collection opening 322 of the waste toner containing section 32, which can collect the waste toner.

(6) With copying repeated, the toner stored in the hopper room 52 is decreased. The toner in the supply toner containing section 31 of the developer container 30 also is decreased. At the same time, the toner remained on the surface of image carrier 1 after image transfer in copying can be collected by the cleaning arrangement 9. It is discharged from the opening of the outlet of a waste toner carrying screw 12. The discharged toner is carried through the hollow cylinder 11 of the collected waste toner carrying arrangement 10 by the waste toner carrying screw 12. It then is discharged from the discharge opening 11A into the waste toner collection opening 322 of the developer container 30.

(7) On the other hand, the developer carrier 41 of the image developing unit 4 can be revolved intermittently whenever copying is made. Its revolution can revolve the gear 327 of the developer container 30 through a drive transmission arrangement. The revolves the revolving shaft 326, which in turn can move the movable partition wall 325 screwed with it at a slow speed in the arrow direction (see FIG. 2). This makes volume of the supply toner containing section 31 contract gradually, and that of the waste toner containing section 32 extend.

(8) If the toner in the supply toner containing section 31 is consumed and if the hopper room 52 lacks of the toner, a toner shortage alarm is indicated on an operation panel of the copying machine. The movable partition wall 325 then reaches a position around the neck 326B of the revolving shaft 326. At that position, the movable partition wall 325 is stopped, but the revolving shaft 326 can be revolved still. It should be noted that the the volume of the waste toner containing section 32 at the position is set so that it can contain an expected amount of the collected waste toner.

(9) When the toner shortage alarm is issued, an operator should handle the lever mentioned in step (5) above to make the shutter 13 close the discharge opening 11A and to swing the hollow cylinder 11 to make the shutter 13 upward to escape.

(10) The shutter member 323 should be slided to close the waste toner collection opening 322. The developer container 30 then should be turned 180 degrees to direct the supply opening 312 upward. The developer container 30 should pulled out from the container room 51. It should be discarded.

(11) Then, the toner supply should be made as described previously.

Figure 4:
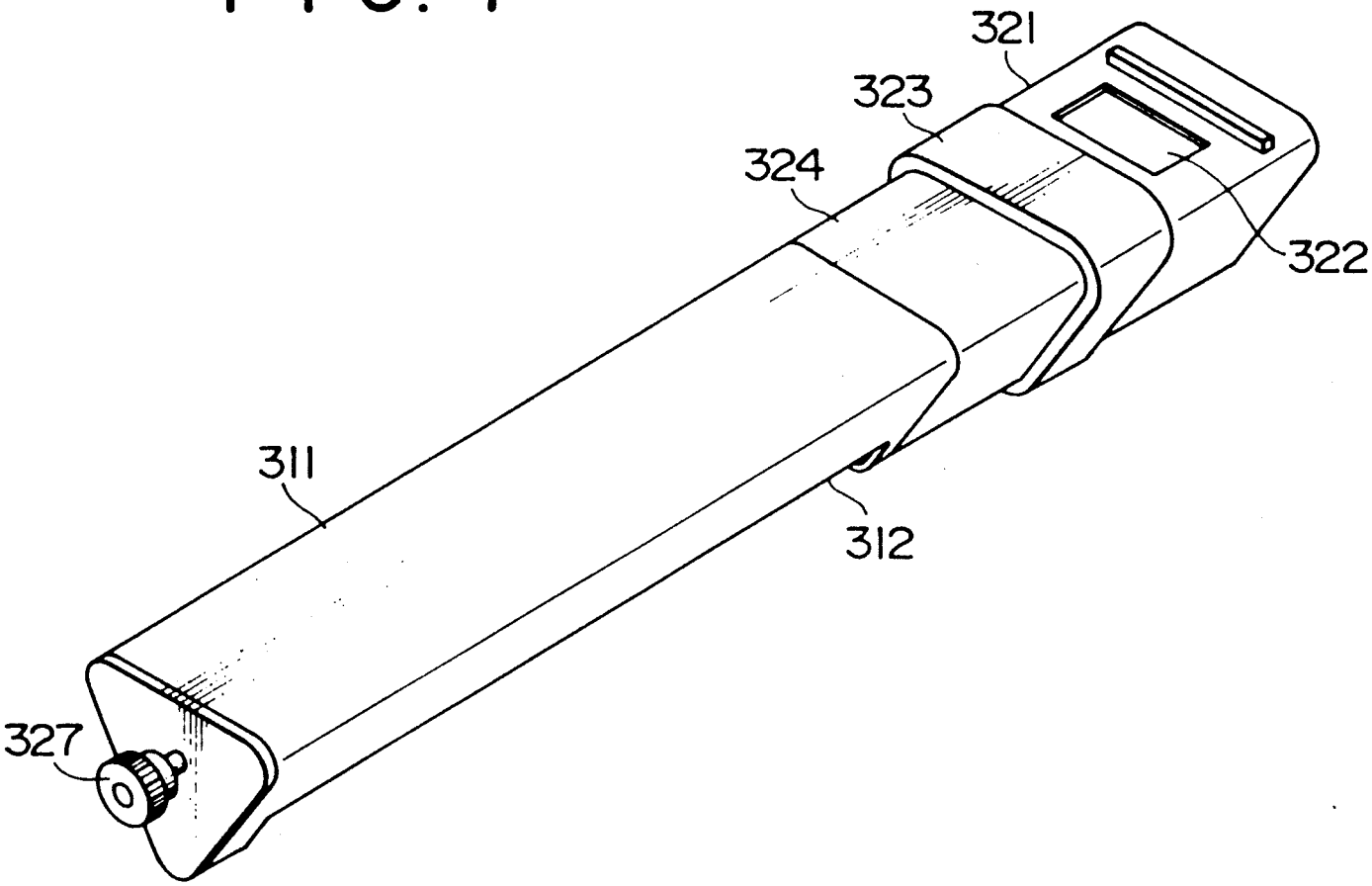
FIG. 4 is a perspective view for another embodiment of the developer container according to the present invention.
Figure 5A:
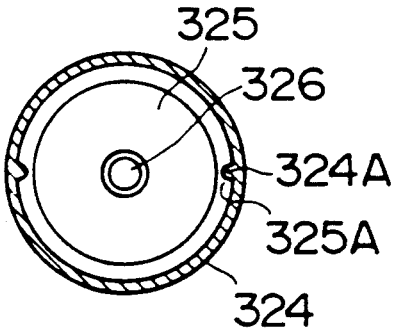
Figure 5B:
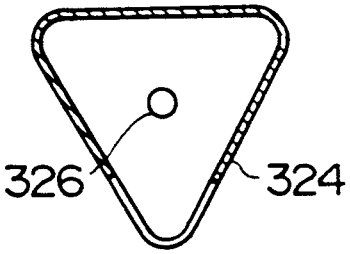
Figure 5C:
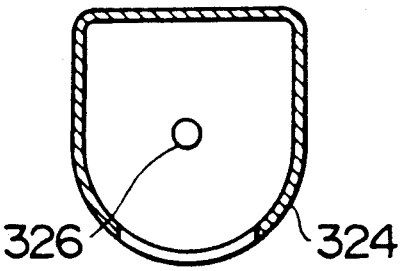
Figure 5D:
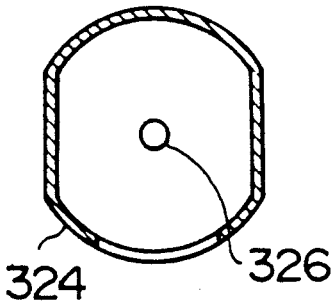

FIG. 4 is a perspective view for another embodiment of the developer container according to the present invention. FIG. 5-B is a cross sectional view for a portion around its center. The identical arrangements and parts in the figures with those in the preceding embodiment are indicated by the same numbers. In the present embodiment, cross sections of outside members forming the developer container are made reverse triangle as shown in FIG. 5B. Such a construction has no projections nor long grooves needed to allow the movable partition wall to move in the longitudinal direction of the developer container as it can be prevented from turning by angles of the triangle.

FIGS. 5-C and 5-D are cross sectional views for other embodiments of the developer container according to the present invention. Similarly, the movable partition wall also can be prevented from turning by providing at least one straight portion in the cross section of outside members of the developer container.

The cross sectional shapes other than the cylindrical one of the first embodiment allows the developer container to be inserted into the container room without turning the developer container.

It should be noted that the developer containers described so far can be arranged to be inserted in the container room obliquely or vertically as well.

As described above, in accordance with the present invention, the toner container has an advantage that the collected waste toner containing section can be replaced together whenever the supply toner containing section is replaced, as the supply toner containing section having new toner contained and the waste toner containing section are integrated together and can be mounted in or demounted from the image developing apparatus. This facilitates replacement of the toner container and can prevent an accident of collected waste toner overflow due to fail of replacement of it.

Also, it has another advantage that detection of full charge of the collected waste toner is not needed as the toner supply and collection can be made simultaneously.

Further, it has the other advantage that size of the whole developer container can be made smaller as the supply toner containing section is contracted smaller and reversely the collected waste toner containing section is expanded larger as the supply toner is consumed as the movable partition wall dividing the supply toner containing section and the collected waste toner containing section can be moved. This means that the developer supply unit for the image recording apparatus can be made smaller.

What is claimed is:

1. A toner container detachably mounted to a developing unit of an image forming apparatus, for supplying fresh toner particles therefrom and storing used toner particles thereinto, the toner container comprising:

partitioning means movably provided inside the toner container for partitioning the toner container into a first section for containing the fresh toner particles and a second section for storing the used toner particles, wherein the first section includes a first opening for supplying the fresh toner particles to the developing unit and the second section includes a second opening for introducing the used toner particles thereinto; and driving means for driving the partitioning means in accordance with comsumption of the fresh toner particles.

2. The toner container of claim 1, wherein the partitioning means decreases the volume of the first section and increases the volume of the second section by moving in a moving direction.

3. The toner container of claim 1, wherein the driving means moves the partitioning means in accordance with the rotation of a developer roller of the developing unit.

4. The toner container of claim 1, further comprising mean for stirring the fresh toner particles contained in the first section.

5. The toner container of claim 1, further comprising means for stopping the partitioning means when the volume of the second section reaches a predetermined volume.

6. A toner container detachably mounted to a developing unit of an image forming apparatus for supplying fresh toner particles therefrom and storing used toner particles thereinto, the container comprising:

a partition plate slidably provided inside the container for partitioning the container into a first section for containing the fresh toner particles and a second section for storing the used toner particles, wherein the first section includes a first opening for supplying the fresh toner particles to the developing unit and the second section includes a second opening for introducing the used toner particles thereinto, the partition plate decreases the volume of the first section and increases the volume of the second section by a sliding motion in a sliding direction; and driving means for converting the rotation of a developing roller of the developing unit into the sliding motion of the partition plate so as to make the partition plate slide in the sliding direction.

* * * * *

UNITED STATES PATENT AND TRADEMARK OFFICE

CERTIFICATE OF CORRECTION

PATENT NO. : 5,084,734

DATED : January 28, 1992

INVENTOR(S) : Masahiro Yoshino et al.

It is certified that error appears in the above-identified patent and that said Letters Patent is hereby corrected as shown below:

Claim 1, column 7, line 13, change "comsumption" to --consumption--.

Claim 4, column 7, line 24, change "mean" to --means--.

Signed and Sealed this

Twenty-sixth Day of October, 1993

*Attest:*

*Attesting Officer*

BRUCE LEHMAN

*Commissioner of Patents and Trademarks*